US007881060B2

(12) United States Patent
Chung et al.

(10) Patent No.: US 7,881,060 B2
(45) Date of Patent: Feb. 1, 2011

(54) HEAT-DISSIPATION MODULE AND ELECTRONIC APPARATUS HAVING THE SAME

(75) Inventors: Ming-Hung Chung, Taipei (TW); Chun-Teng Chiu, Taipei (TW); Yu-Chen Lee, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 28 days.

(21) Appl. No.: 12/398,159

(22) Filed: Mar. 4, 2009

(65) Prior Publication Data

US 2009/0273904 A1 Nov. 5, 2009

(30) Foreign Application Priority Data

Apr. 30, 2008 (TW) ..... 97115898

(51) Int. Cl.
*H05K 7/20* (2006.01)

(52) U.S. Cl. ..... 361/700; 361/679.47; 361/679.52; 361/679.54; 361/679.55; 361/715; 165/80.3; 165/104.21; 165/104.26; 165/104.33

(58) Field of Classification Search ..... 361/679.46, 361/679.47, 679.52, 690–697, 700–712, 361/715–724; 257/706–727; 165/80.3, 80.4, 165/80.5, 104.21, 104.26, 104.33, 185; 174/15.2, 174/16.3, 252
See application file for complete search history.

(56) References Cited

U.S. PATENT DOCUMENTS 5,712,762 A * 1/1998 Webb ..... 361/679.54
5,875,095 A * 2/1999 Webb ..... 361/700
6,058,012 A * 5/2000 Cooper et al. ..... 361/704
6,404,627 B1 * 6/2002 Tanaka et al. ..... 361/679.52
6,549,404 B1 * 4/2003 Kitahara et al. ..... 361/695
7,278,470 B2 * 10/2007 Xia et al. ..... 165/104.33
7,319,588 B2 * 1/2008 Peng et al. ..... 361/700
7,343,962 B2 * 3/2008 Xia et al. ..... 165/80.3
7,369,412 B2 * 5/2008 Peng et al. ..... 361/715
7,493,939 B2 * 2/2009 Xia et al. ..... 165/104.26
7,520,316 B2 * 4/2009 Xia et al. ..... 165/104.33
7,558,065 B2 * 7/2009 Fang et al. ..... 361/700
7,580,262 B2 * 8/2009 Chou et al. ..... 361/700

(Continued)

FOREIGN PATENT DOCUMENTS

CN 2370461 3/2000

(Continued)

OTHER PUBLICATIONS

"Office Action of China Counterpart Application", issued on May 27, 2010, p. 1-p. 6

*Primary Examiner*—Michael V Datskovskiy
(74) *Attorney, Agent, or Firm*—Jianq Chyun IP Office

(57) ABSTRACT

An electronic apparatus including a circuit board having multiple heat generating elements and a heat-dissipation module is provided. The heat-dissipation module includes a heat-dissipation plate and a heat pipe set. The heat-dissipation plate having a first surface and a second surface is disposed on the circuit board and having multiple contacting portions and at least one heat pipe protecting portion connecting the contacting portions. The contacting portions are used for receiving heat from the heat generating elements. A heat pipe accommodating groove passing through the heat pipe protecting portion is set on the first surface. The heat pipe set is disposed in the heat pipe accommodating groove of the heat-dissipation plate.

20 Claims, 2 Drawing Sheets

U.S. PATENT DOCUMENTS

| | | | | |
|---|---|---|---|---|
| 7,637,311 | B2 * | 12/2009 | Zheng et al. | 165/80.3 |
| 7,694,727 | B2 * | 4/2010 | Yang et al. | 165/104.33 |
| 2008/0173430 | A1 * | 7/2008 | Jin et al. | 165/104.33 |
| 2008/0310122 | A1 * | 12/2008 | Chou et al. | 361/720 |

FOREIGN PATENT DOCUMENTS

| | | |
|---|---|---|
| CN | 1536657 | 10/2004 |
| CN | 200972858 Y | 11/2007 |

* cited by examiner

HEAT-DISSIPATION MODULE AND ELECTRONIC APPARATUS HAVING THE SAME

CROSS-REFERENCE TO RELATED APPLICATION

This application claims the priority benefit of Taiwan application serial no. 97115898, filed on Apr. 30, 2008. The entirety of the above-mentioned patent application is hereby incorporated by reference herein and made a part of this specification.

BACKGROUND OF THE INVENTION

1. Field of the Invention

The present invention generally relates to a heat-dissipation module and an electronic apparatus having the same, in particular, to a heat-dissipation module capable of simultaneously cooling multiple heat generating elements on a circuit board and an electronic apparatus having the same.

2. Description of Related Art

In recent years, with the enormous progress of the computer technology, the operating speed of the computer is continuously increased, and the heat generation rate of electronic elements within a computer host continuously rises correspondingly. In order to prevent the electronic elements within the computer host from overheating to cause a temporary or permanent failure to the electronic element, how to provide sufficient heat-dissipation performance to the electronic elements within the computer is accordingly important.

For example, in a computer system, for example, a center process unit (CPU), a north bridge chip, a south bridge chip, or other heat generating elements are disposed on a mother board. In the prior art, in order to remove the heat on the mother board generated during the high speed operation, a heat-dissipation module is usually disposed on these heat generating elements for performing the heat dissipation.

Generally speaking, the heat-dissipation module includes multiple heat-dissipation bases and multiple heat pipes connected between two heat-dissipation bases. Every heat-dissipation base is placed one heat generating element of the mother board. The heat pipes can transfer heat generated by the heat generating elements to the heat-dissipation bases, so as to cool the heat generating elements. However, during the transportation of the heat-dissipation module, the heat pipes are easily bent and deformed due to vibrations or improper external pressures. Furthermore, in the process of installing the heat-dissipation module to the mother board, the heat pipes are also easily bent and deformed due to improper operations of the operator. Once the heat pipes are bent and deformed, the heat-dissipation efficiency of the heat-dissipation module is poor. In addition, the heat-dissipation module in which the heat pipes are bent and deformed is not easy to be effectively assembled onto the mother board, such that some of the heat-dissipation bases cannot be reliably bonded with the heat generating elements, which seriously affects the heat-dissipation efficiency. Furthermore, if the heat-dissipation module is forced to be installed onto the mother board such that the heat-dissipation bases are bonded with the heat generating elements, the mother board may be bent and deformed, and even wires or elements on the mother board may be destroyed.

SUMMARY OF THE INVENTION

Accordingly, the present invention is directed to a heat-dissipation module having preferred heat-dissipation efficiency.

The present invention is further directed to an electronic apparatus having preferred reliability.

The present invention provides a heat-dissipation module including a heat-dissipation plate and a heat pipe set. The heat-dissipation plate having a first surface and a second surface includes multiple contacting portions and at least one heat pipe protecting portion connecting the contacting portions. A heat pipe accommodating groove passing through the heat pipe protecting portion is set on the first surface. The heat pipe set is disposed in the heat pipe accommodating groove of the heat-dissipation plate.

The present invention further provides an electronic apparatus including a circuit board having multiple first heat generating elements and a heat-dissipation module. The heat-dissipation module includes a heat-dissipation plate and a heat pipe set. The heat-dissipation plate having a first surface and a second surface is disposed on the circuit board, and includes multiple contacting portions and at least one heat pipe protecting portion connecting the contacting portions. The contacting portions are used for receiving heat from the first heat generating elements. A heat pipe accommodating groove passing through the heat pipe protecting portion is set on the first surface. The heat pipe set is disposed in the heat pipe accommodating groove of the heat-dissipation plate.

In an embodiment of the heat-dissipation module and the electronic apparatus, the heat-dissipation plate is an integrally formed metal die casting.

In an embodiment of the heat-dissipation module and the electronic apparatus, the heat-dissipation module further includes multiple heat conducting plates disposed on the first surface and located at the contacting portions. The contacting portions receive heat from the first heat generating elements via the heat conducting plates.

In an embodiment of the heat-dissipation module and the electronic apparatus, the heat-dissipation module further includes a heat-dissipation base disposed on the circuit board for receiving heat from the first heat generating elements. The heat pipe set connects the heat-dissipation base and the heat-dissipation plate. Furthermore, the heat-dissipation module may further include a fins assembly disposed at the heat-dissipation base.

In an embodiment of the heat-dissipation module and the electronic apparatus, the circuit board further has a second heat generating element. An element accommodating groove is further set on the first surface, for accommodating the second heat generating element.

In an embodiment of the heat-dissipation module and the electronic apparatus, the electronic apparatus further includes multiple screws. Multiple screw hole posts are further set on the first surface, and the screws are secured at the screw hole posts through multiple holes of the circuit board.

In an embodiment of the heat-dissipation module and the electronic apparatus, the heat-dissipation module further includes a fins assembly disposed on the second surface and located at one of the contacting portions.

In an embodiment of the electronic apparatus, the first heat generating elements include a south bridge chip and a north bridge chip.

In view of the above, in the heat-dissipation module and the electronic apparatus of the present invention, since the heat pipe set is disposed in the heat pipe accommodating groove of the heat-dissipation plate, it is ensured that the heat pipes are not bent and deformed. Thereby, the heat-dissipation module of the present invention has preferred heat-dissipation efficiency, and the electronic apparatus of the present invention has preferred reliability.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
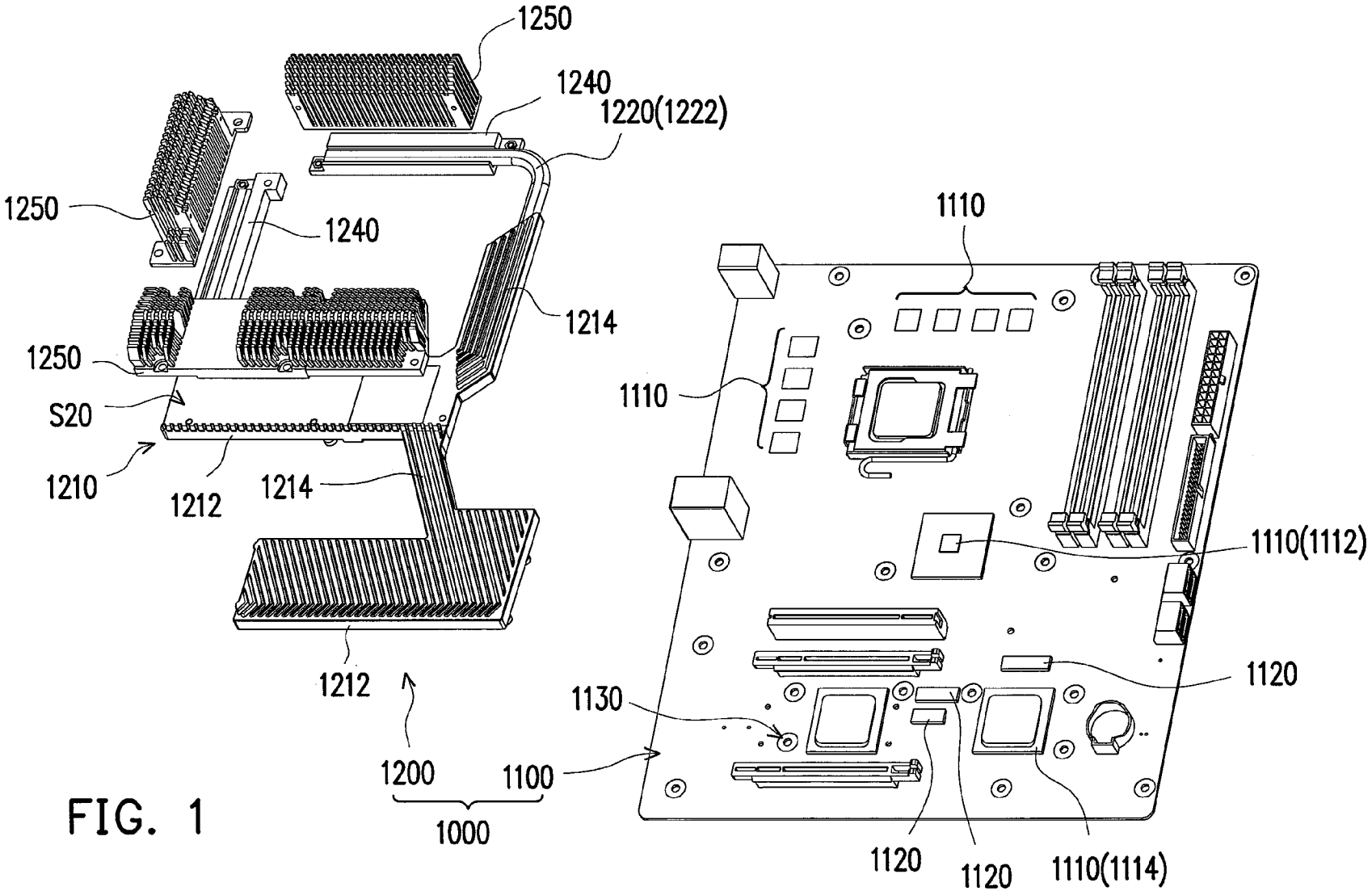
FIG. 1 is an exploded view of an electronic apparatus according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
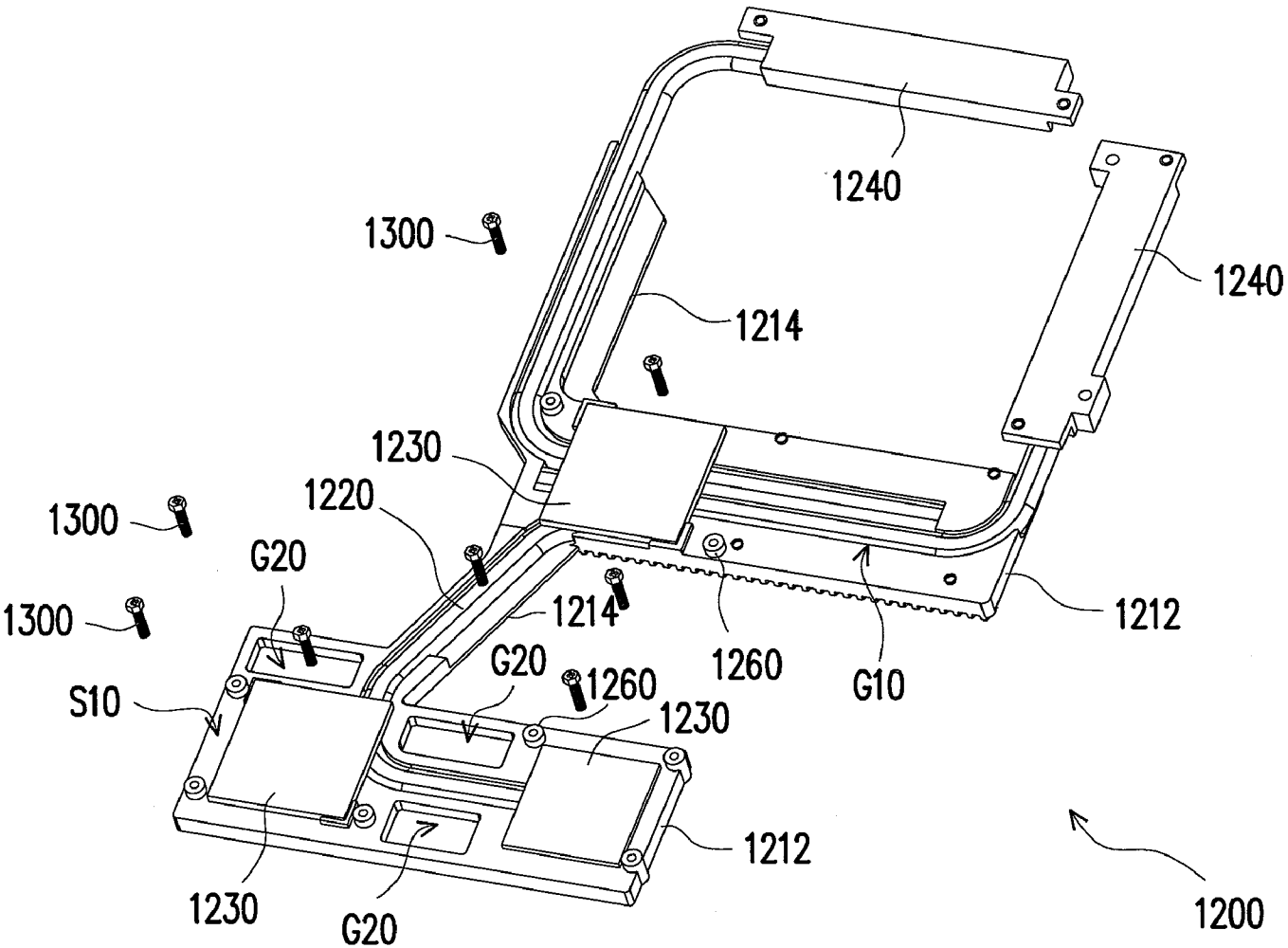
FIG. 2 is a schematic rear view of some elements of a heat-dissipation module in FIG. 1.

FIG. 1 is an exploded view of an electronic apparatus according to an embodiment of the present invention. FIG. 2 is a schematic rear view of some elements of a heat-dissipation module in FIG. 1. Referring to FIGS. 1 and 2, the electronic apparatus 1000 in this embodiment includes a circuit board 1100 and a heat-dissipation module 1200. The circuit board 1100 is, for example, a mother board or other circuit board. The circuit board 1100 has multiple heat generating elements 1110 including, for example, a north bridge chip 1112, a south bridge chip 1114, or other heat generating elements. The heat-dissipation module 1200 includes a heat-dissipation plate 1210 and a heat pipe set 1220. The heat-dissipation plate 1210 is disposed on the circuit board 1100, but in FIG. 1, the state before installing the heat-dissipation module 1200 to the circuit board 1100 is shown. The heat-dissipation plate 1210 includes multiple contacting portions 1212 and at least one heat pipe protecting portion 1214 connecting the contacting portions 1212. This embodiment takes two heat pipe protecting portions 1214 for example, in which one connects two contacting portions 1212 and the other connects one contacting portion 1212. The heat-dissipation plate 1210 has a first surface S10 and a second surface S20. The contacting portions 1212 are suitable for contacting with the heat generating elements 1110, so as to cool the heat generating elements 1110. A heat pipe accommodating groove G10 passing through the heat pipe protecting portion 1214 is set on the first surface S10. The heat pipe set 1220 is disposed in the heat pipe accommodating groove G10 of the heat-dissipation plate 1210. The heat pipe set 1220 in this embodiment includes multiple heat pipes 1222, but these heat pipes 1222 may also be integrated into a single heat pipe.

In the heat-dissipation module 1200 of this embodiment, the heat pipe set 1220 is disposed in the heat pipe accommodating groove G10, so as to protect the heat pipe set 1220 by the heat-dissipation plate 1210 of a single sheet and having a preferred strength. Therefore, before assembling the heat-dissipation module 1200 to the circuit board 1100, the heat pipe set 1220 may be protected from bending and deformation due to external pressures. Moreover, the bending and deformation of the heat pipe set 1220 due to an improper application of force in the process of assembling the heat-dissipation module 1200 may also be avoided. In this way, an optimal contact maintained between the heat-dissipation module 1200 and the heat generating elements 1110 may be ensured, so as to obtain the optimal heat-dissipation efficiency, and thereby raising the reliability of the electronic apparatus 1000 in this embodiment.

Other variations of the electronic apparatus 1000 and the heat-dissipation module 1200 thereof are illustrated below still with reference to FIGS. 1 and 2, but not intended to limit the present invention.

The heat-dissipation plate 1210 in this embodiment may be an integrally formed metal die casting. Furthermore, the heat-dissipation module 1200 in this embodiment may further include multiple heat conducting plates 1230 disposed on the first surface S10 and located at the contacting portions. The contacting portions 1212 receive heat from the heat generating elements 1110 via the heat guiding plates 1230. In addition, the material the heat conducting plate 1230 includes, for example, copper with a high heat conduction speed or other materials with good heat conduction efficiency. A heat-dissipation paste may be coated between the heat conducting plate 1230 and the heat generating elements 1110 to improve the heat-dissipation efficiency. Moreover, at least one heat pipe 1222 of the heat pipe set 1220 in this embodiment may be a copper pipe (the heat pipes 1222 may also be made of other materials having good heat conduction efficiency), and a fluid may exist within the heat pipes 1222 to carry out a thermal convection. The heat pipes 1222 are, for example, fixed in the heat pipe accommodating groove G10 by aluminium epoxy that also has the function of improving the heat-dissipation efficiency. A good thermal contact between the heat conducting plate 1230 and the heat pipes 1222 is preferred.

The heat-dissipation module 1200 in this embodiment may further include at least one heat-dissipation base 1240 adapted to be disposed on the circuit board 1100 for receiving heat from the heat generating elements 1100, so as to reduce the temperature of the heat generating elements 1110. The heat pipes 1222 of the heat pipe set 1220 connect the heat-dissipation base 1240 and the heat-dissipation plate 1210. Furthermore, the heat-dissipation module 1200 in this embodiment may further include at least one fins assembly 1250. This embodiment provides multiple fins assemblies 1250, some of the fins assemblies 1250 are disposed at the heat-dissipation bases 1240, and some of the fins assemblies 1250 are disposed on the second surface S20 of the heat-dissipation plate 1210 and located at the contacting portions 1212. The fins assemblies 1250 have multiple fins to increase a heat-dissipation area. The fins assemblies 1250 are, for example, fixed to the heat-dissipation bases 1240 and the heat-dissipation plate 1210 by screws or other securing members (not shown). Moreover, the heat-dissipation module 1200 may also further include a fan (not shown) to further improve the heat-dissipation efficiency.

In addition, the circuit board 1100 in this embodiment may further have at least one heat generating element 1120. A corresponding element accommodating groove G20 for accommodating the heat generating element 1120 may be set on the first surface S10 of the heat-dissipation plate 1210. The reduction of an area of the heat-dissipation plate 1210 in order to evade the heat generating element 1120 may be avoided with the design of the element accommodating groove G20.

Moreover, multiple screw hole posts 1260 are further set on the first surface S10 of the heat-dissipation plate 1210 in this embodiment. The electronic apparatus 1000 may further include multiple screws 1300 (shown in FIG. 2) for being secured at the screw hole posts 1260 through multiple holes 1130 of the circuit board 1100.

In view of the above, in the heat-dissipation module and the electronic apparatus of the present invention, the heat pipe set is protected by the heat-dissipation plate of a single sheet and having preferred strength. Therefore, it may be ensured that the heat pipes are not bent and deformed no matter during the transportation or installation. Thereby, the heat-dissipation module of the present invention may be reliably bonded with the heat generating elements to have preferred heat-dissipation efficiency. Furthermore, since the heat-dissipation module may be reliably bonded with the heat generating elements, the circuit board with the assistance of the heat-dissipation module is not easy to be bent, thereby increasing the reliability of the electronic apparatus of the present invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A heat-dissipation module, comprising:

a heat-dissipation plate, having multiple contacting portions and at least one heat pipe protecting portion connecting the contacting portions, and having a first surface and a second surface, wherein a heat pipe accommodating groove passing through the heat pipe protecting portion is set on the first surface;

a fins assembly, disposed on the second surface and located at one of the contacting portions; and a heat pipe set, disposed in the heat pipe accommodating groove of the heat-dissipation plate.

2. The heat-dissipation module according to claim 1, wherein the heat-dissipation plate is an integrally formed metal die casting.

3. The heat-dissipation module according to claim 1, further comprising multiple heat conducting plates disposed on the first surface and located at the contacting portions, wherein the contacting portions receive heat from the first heat generating elements via the heat conducting plates.

4. The heat-dissipation module according to claim 1, further comprising a heat-dissipation base, wherein the heat pipe set connects the heat-dissipation base and the heat-dissipation plate.

5. The heat-dissipation module according to claim 4, further comprising a fins assembly disposed at the heat-dissipation base.

6. The heat-dissipation module according to claim 1, wherein an element accommodating groove is further set on the first surface.

7. The heat-dissipation module according to claim 1, wherein multiple screw hole posts are further set on the first surface.

8. An electronic apparatus, comprising:

a circuit board, having multiple first heat generating elements; and a heat-dissipation module, comprising:

a heat-dissipation plate, disposed on the circuit board, having multiple contacting portions and at least one heat pipe protecting portion connecting the contacting portions, and having a first surface and a second surface, wherein the contacting portions are used for receiving heat from the first heat generating elements, and a heat pipe accommodating groove passing through the heat pipe protecting portion is set on the first surface;

a heat pipe set, disposed in the heat pipe accommodating groove of the heat-dissipation plate; and multiple heat conducting plates, disposed on the first surface and located at the contacting portions, wherein the contacting portions receive heat from the first heat generating elements via the heat conducting plates.

9. The electronic apparatus according to claim 8, wherein the heat-dissipation plate is an integrally formed metal die casting.

10. The electronic apparatus according to claim 8, wherein the heat-dissipation module further comprises a heat-dissipation base disposed on the circuit board for receiving heat from the first heat generating elements, and the heat pipe set connects the heat-dissipation base and the heat-dissipation plate.

11. The electronic apparatus according to claim 10, wherein the heat-dissipation module further comprises a fins assembly disposed at the heat-dissipation base.

12. The electronic apparatus according to claim 8, wherein the circuit board further includes a second heat generating element, and an element accommodating groove for accommodating the second heat generating element is further set on the first surface.

13. The electronic apparatus according to claim 8, further comprising multiple screws, wherein multiple screw hole posts are further set on the first surface, and the screws are secured at the screw hole posts through multiple holes of the circuit board.

14. The electronic apparatus according to claim 8, wherein the heat-dissipation module further comprises a fins assembly disposed on the second surface and located at one of the contacting portions.

15. A heat-dissipation module, comprising:

a heat-dissipation plate, having multiple contacting portions and at least one heat pipe protecting portion connecting the contacting portions, and having a first surface and a second surface, wherein a heat pipe accommodating groove passing through the heat pipe protecting portion is set on the first surface;

a heat pipe set, disposed in the heat pipe accommodating groove of the heat-dissipation plate; and a heat-dissipation base, wherein the heat pipe set connects the heat-dissipation base and the heat-dissipation plate.

16. The heat-dissipation module according to claim 15, wherein the heat-dissipation plate is an integrally formed metal die casting.

17. The heat-dissipation module according to claim 15, further comprising multiple heat conducting plates disposed on the first surface and located at the contacting portions, wherein the contacting portions receive heat from the first heat generating elements via the heat conducting plates.

18. The heat-dissipation module according to claim 15, further comprising a fins assembly disposed at the heat-dissipation base.

19. The heat-dissipation module according to claim 15, wherein an element accommodating groove is further set on the first surface.

20. The heat-dissipation module according to claim 15, wherein multiple screw hole posts are further set on the first surface.

* * * * *